US007681313B2

(12) United States Patent
Zurawel et al.

(10) Patent No.: US 7,681,313 B2
(45) **Date of Patent: *Mar. 23, 2010**

(54) HEAT EXCHANGER PLATES AND METHODS FOR MANUFACTURING HEAT EXCHANGER PLATES

(75) Inventors: Peter Zurawel, Mississauga (CA); Brian Ernest Duke, Carlisle (CA); Raymond R. Caron, Burlington (CA); Craig Lambert, Burlington (CA); Eric Luvisotto, Mississauga (CA)

(73) Assignee: Dana Canada Corporation, Ontario (CA)

( * ) Notice: Subject to any disclaimer, the term of this patent is extended or adjusted under 35 U.S.C. 154(b) by 971 days.

This patent is subject to a terminal disclaimer.

(21) Appl. No.: 10/547,049

(22) PCT Filed: Feb. 27, 2004

(86) PCT No.: PCT/CA2004/000291

§ 371 (c)(1),
(2), (4) Date: Aug. 26, 2005

(87) PCT Pub. No.: WO2004/076093

PCT Pub. Date: Sep. 10, 2004

(65) Prior Publication Data

US 2006/0169444 A1 Aug. 3, 2006

(30) Foreign Application Priority Data

Feb. 27, 2003 (CA) ..... 2420273

(51) Int. Cl.
*B21D 53/02* (2006.01)

(52) U.S. Cl. ..... 29/890.03; 29/726; 29/890.039; 29/890.04; 29/432; 72/398; 72/405.06; 165/150; 165/151; 165/152

(58) Field of Classification Search ..... 29/890.03, 29/890.031, 432, 432.1, 557, 726, 890.039, 29/890.04; 165/67, 78, 79, 150, 151, 152, 165/166; 72/398, 405.06
See application file for complete search history.

(56) References Cited

U.S. PATENT DOCUMENTS

| | | | | |
|---|---|---|---|---|
| 2,652,620 | A | | 9/1953 | Sutowski |
| 4,327,802 | A | | 5/1982 | Beldam |
| 4,401,154 | A | | 8/1983 | Anders et al. |
| 4,470,455 | A | * | 9/1984 | Sacca ..... 165/167 |
| 4,497,196 | A | | 2/1985 | Bakermans et al. |
| 4,688,631 | A | | 8/1987 | Peze et al. |

(Continued)

FOREIGN PATENT DOCUMENTS

| | | | |
|---|---|---|---|
| EP | 0 726 104 | A | 8/1996 |

(Continued)

*Primary Examiner*—David P Bryant
*Assistant Examiner*—Bayan Salone
(74) *Attorney, Agent, or Firm*—Marshall & Melhorn, LLC

(57) ABSTRACT

A method for forming heat exchanger plates (10) comprises formation of a fluid flow channel (28) along the edges (22) of a sheet metal strip or blank, and formation of a pair of raised end bosses. The raised end bosses (32) are elongated in the longitudinal dimension and are formed within the final width dimension of the plate so as to avoid the need for trimming of excess material along the edges of the plate. The method generates less scrap than prior art processes using progressive stamping, and also permits variation of the plate lengths.

21 Claims, 15 Drawing Sheets

U.S. PATENT DOCUMENTS

| | | | | |
|---|---|---|---|---|
| 5,150,520 | A | 9/1992 | DeRisi | |
| 5,176,205 | A | 1/1993 | Anthony | |
| 5,407,004 | A | 4/1995 | DeRisi et al. | |
| 5,538,077 | A * | 7/1996 | So et al. | 165/109.1 |
| 5,697,246 | A * | 12/1997 | Kuroda et al. | 72/356 |
| 5,697,429 | A | 12/1997 | Laveran et al. | |
| 5,800,673 | A | 9/1998 | Okuda et al. | |
| 5,810,077 | A | 9/1998 | Nakamura et al. | |
| 5,896,916 | A | 4/1999 | Baechner et al. | |
| 5,918,664 | A | 7/1999 | Torigoe | |
| 6,122,814 | A | 9/2000 | Pennig et al. | |
| 6,145,587 | A | 11/2000 | Hanafusa | |
| 6,241,011 | B1 | 6/2001 | Nakamura et al. | |
| 6,256,856 | B1 | 7/2001 | Squillacci, Jr. et al. | |
| 6,273,183 | B1 | 8/2001 | So et al. | |
| 6,332,495 | B1 | 12/2001 | Jamison et al. | |
| 6,467,536 | B1 | 10/2002 | Abate et al. | |
| 6,675,618 | B2 * | 1/2004 | Matsuzaki | 72/16.2 |
| 6,823,933 | B2 | 11/2004 | Chiba | |
| 6,837,305 | B2 | 1/2005 | Zurawel et al. | |
| 2002/0000309 | A1 | 1/2002 | Kim et al. | |

FOREIGN PATENT DOCUMENTS

| | | |
|---|---|---|
| FR | 2 058 396 A | 5/1971 |
| GB | 1 068 763 A | 5/1967 |
| JP | 62286632 | 12/1987 |
| WO | WO 99/11995 | 3/1999 |

* cited by examiner

HEAT EXCHANGER PLATES AND METHODS FOR MANUFACTURING HEAT EXCHANGER PLATES

This application is the national stage application of, and claims priority to, International Application No. PCT/CA2004/000291 filed Feb. 27, 2004, the entire disclosure of which is incorporated herein by reference. The International Application was published in the English language on Sep. 10, 2004 as International Publication No. WO 2004/76093 A1 and itself claims the benefit of Canadian Patent Application No. 2,420,273, filed on Feb. 27, 2003, the entire disclosure of which is incorporated herein by reference.

FIELD OF THE INVENTION

The invention relates to methods for manufacturing plates for heat exchangers, particularly to methods in which generation of scrap is reduced, and to heat exchanger plates made by these methods.

BACKGROUND OF THE INVENTION

Heat exchangers are commonly made from multiple stacked plate pairs which define coolant flow passages extending between a pair of headers. As shown in FIG. 1 of U.S. Pat. No. 6,273,183 issued on Aug. 14, 2001 to So et al., the plates of each pair are arranged in back-to-back relation and are joined together at their peripheral edges. The plates have raised central portions which define a flow passage therebetween and in which turbulizers may be located. Raised bosses are provided at the ends of the plates, and are apertured to provide inlet and outlet openings. When the heat exchanger is assembled, the bosses are aligned and in communication with one another thereby forming a pair of headers. Expanded metal fins may then be located between the plate pairs to allow another fluid, such as air, to flow transversely through the plate pairs. The raised end bosses also serve to create spaces between the plate pairs for insertion of the fins.

The individual plates making up such a heat exchanger are usually formed by a process known as "progressive stamping" in which the plates are progressively formed by successive stamping operations performed on a coil of sheet metal. As explained above, the end bosses must be of a sufficient height to allow insertion of cooling fins. The bosses must also be of a specific diameter or area to allow sufficient coolant flow through the headers. Thus, the strip width required for each plate is generally determined by the width of strip material required for formation of the bosses.

In many cases, the width of strip material required to form the bosses is greater than a desired width of the plate pairs. This results in the need to trim excess material along the edges of the plates, particularly between the end portions in which the bosses are formed. The amount of scrap material generated by conventional progressive stamping of heat exchanger plates can be as high as 35 percent.

Thus, there is a need for improved methods of forming heat exchanger plates in which generation of scrap is reduced or eliminated, and in which plates of varying lengths may be produced without excessive tooling costs.

SUMMARY OF THE INVENTION

In one aspect, the present invention provides a method for forming a plate for a heat exchanger, the plate having a length and a width, the length defining a longitudinal axis, the method comprising: (a) providing a flat, sheet metal strip having elongate, longitudinally extending side edges, the strip having a width substantially the same as the width of the plate; (b) forming a fluid flow channel extending along the side edges of the strip, the fluid flow channel being raised relative to the side edges; and (c) forming a pair of raised bosses in the strip, the bosses being raised relative to the side edges and the fluid flow channels, wherein a longitudinal dimension of the bosses is greater than a transverse dimension of the bosses.

In another aspect, the present invention provides a heat exchanger plate, comprising: (a) a central portion defining an elongate fluid flow channel; (b) a pair of end portions separated by the central portion; (c) a raised boss provided in each of the end portions, each raised boss having an interior and an upper surface provided with a fluid flow aperture, wherein the interiors of the bosses are in communication with the fluid flow channel; (d) a planar flange extending continuously about an entire periphery of the plate and surrounding the fluid flow channel and the raised bosses; and (e) a plurality of tabs, each of which is integrally formed with the flange and extends from the flange, each of the tabs being located in one of the end portions of the plate.

In yet another aspect, the present invention provides A heat exchanger, comprising a plurality of plate pairs formed from the heat exchanger plates according to the invention, each of the plate pairs being formed by sealing the flanges of the plates together with the interiors of the bosses of one plate communicating with the interiors of the bosses of the other plate and so that the central portions of the plates combine to form a fluid passage in communication with the interiors of the bosses, the plate pairs being stacked with the apertures of the bosses in registry, the bosses of the plate pairs forming a pair of headers.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
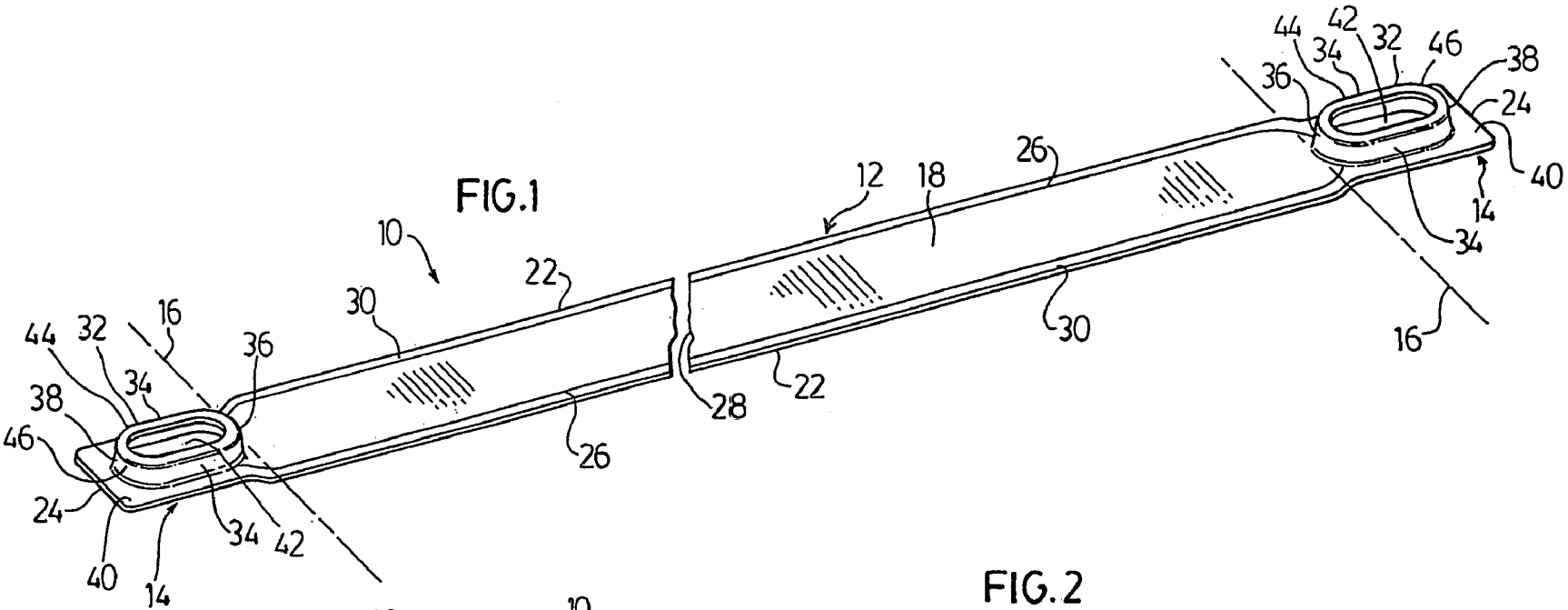
FIG. 1 is a top, perspective view of a preferred heat exchanger plate according to the present invention.
Figure 2:
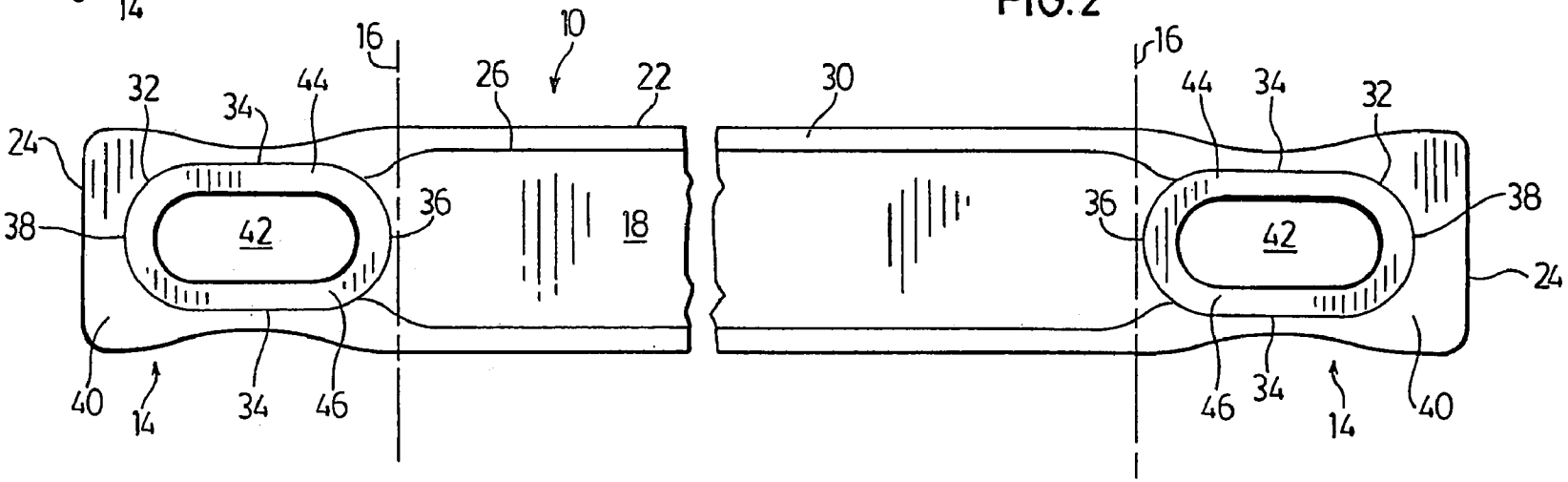
FIG. 2 is a top plan view of the plate shown in FIG. 1.
Figure 3:
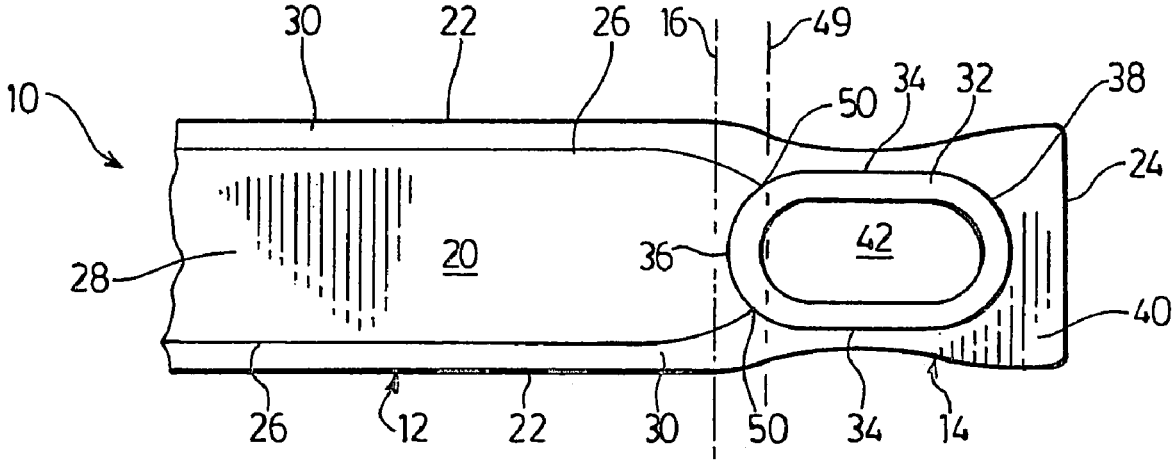
FIG. 3 is a bottom plan view of one end of the plate shown in FIG. 1.

FIGS. 1 to 3 illustrate a preferred heat exchanger plate 10 according to the present invention. The plate 10 has an elongate central portion 12 located between a pair of end portions 14. Dotted lines 16 shown in FIGS. 1 to 3 indicate the approximate boundaries between the central portion 12 and the end portions 14.

The plate 10 has an upper surface 18 and an opposed lower surface 20, with elongate side edges 22 extending along the entire length of plate 10 and terminating at end edges 24. Extending along the side edges 22 of plate 10 are a pair of shoulders 26, these shoulders 26 defining a longitudinally extending fluid flow channel 28 extending along the lower surface 20 of plate 10. The fluid flow channel 28 preferably extends along substantially the entire central portion 12 of plate 10, and may preferably extend beyond dotted lines 16 into the end portions 14 of plate 10. The shoulders 26 are spaced from the side edges 22 so as to form flat peripheral side flanges 30 between the side edges 22 and the shoulders 26. The side flanges 30 extend longitudinally along the side edges 22 between the end portions 14.

Located in the end portions 14 of plate 10 are a pair of raised bosses 32. The bosses 32 are raised relative to the side edges 22 and relative to the fluid flow channel 28, having a height sufficient such that when a heat exchanger is formed by stacking plate pairs formed from plates 10, each plate pair formed by joining a pair of plates 10 with their lower surfaces facing one another, sufficient space exists between the plate pairs for insertion of cooling fins.

The bosses 32 can be of any desired shape, including circular. Preferably, the bosses 32 each have a major diameter extending in the longitudinal direction which is greater than a minor diameter extending in the transverse direction. Most preferably, the bosses are of an oval shape. As used herein, the term "oval" refers to any non-circular shape having a generally smoothly curving periphery, such as an ellipse, a rectangle with rounded corners, or other oblong or egg shape. In the preferred embodiment shown in the drawings, the bosses 32 are oval in plan view, having substantially straight longitudinally extending sides 34 extending between smoothly curved ends, a proximal end 36 located at or near the dotted line 16 between the central portion 12 and end portions 14, and a distal end 38 located proximate the end edge 24 of the plate 10.

As shown in FIG. 2, the sides 34 of bosses 32 are spaced inwardly from the side edges 22 and the distal ends 38 of bosses 32 are spaced inwardly from the end edges 24, thereby forming peripheral end flanges 40 extending around the end portions 14 of plate 10. The side flanges 30 and peripheral end flanges 40 combine to form a continuous flange about the entire periphery of the plate 10. The continuous flange provides a surface along which a pair of plates 10 can be joined, for example by brazing, in back-to-back relation (with lower surfaces 20 facing one another) to form a plate pair.

In order to provide fluid communication through the headers after assembly of the heat exchanger, the upper surface 44 of each boss 32 is provided with an aperture 42. The area of the aperture 42 is sufficiently large to provide adequate fluid flow throughout the header, while maintaining an annular sealing surface 46 on the upper surface 44. During assembly of the heat exchanger, adjacent plate pairs are joined to one another, for example by brazing, along the annular sealing flanges 46. As shown in the preferred plate 10, the aperture 42 may preferably be centred on upper surface 44 and may generally follow the shape of the raised bosses 32, although this is not essential.

As best seen in the bottom plan view of FIG. 3, the side flanges 30 become broader and curve inwardly toward one another as they approach the bosses 32, such that the side flanges 30 intersect the bosses 32 at points 50 which are located proximate the intersection between the sides 34 and the proximal ends 36 of the bosses 32. Thus, each peripheral end flange 40 substantially extends only around the sides 34 and distal end 38 of a boss 32, leaving an area 49 (substantially coextensive with proximal end 36) at which the fluid flow channel 28 is in flow communication with the interior of the boss 32.

As mentioned above, the plate pairs formed from plates 10 may be provided with turbulizers such as the expanded metal turbulizers disclosed in the above-mentioned patent to So et al., which is incorporated by reference herein in its entirety. The turbulizers are preferably rectangular in shape and are received between the plates 10 of the plate pairs, preferably extending throughout substantially the entire central portions 12 of the plates 10. As well as enhancing heat transfer, turbulizers provide support for the central portions 12 of plates 10, preventing collapse or narrowing of the fluid flow channels 28. In a heat exchanger constructed from pairs of plates 10, the ends of the turbulizers preferably overlap the proximal curved ends 36 of the bosses 32, so that the turbulizers provide support along the entire length of the fluid flow channels 28. The inward tapering of the side flanges 30 functions as an integral turbulizer stop so as to prevent longitudinal sliding of the turbulizer between the plate pairs. A preferred position of the end of a turbulizer (not shown) is indicated by dotted line 51 in FIG. 3.

Having now described the preferred heat exchanger plate 10 according to the invention, the following is a description of preferred methods for manufacturing a heat exchanger plate 10 according to the invention.

One preferred method of the invention begins by providing a sheet metal strip 52, preferably comprised of a brazeable material, which is preferably selected from the group comprising aluminum, an aluminum alloy, and aluminum or aluminum alloy clad with an aluminum brazing alloy. The strip 52 as defined herein is of indefinite length, having longitudinally extending side edges 54, an upper surface and an opposed lower surface (not shown). The width of strip 52, measured in the transverse direction, is substantially the same as the width of the plate 10 described above.

A plurality of strips 52 may be formed by longitudinally slitting a coil of sheet metal (having a width greater than the width of strip 52) at one or more points across its width, with the longitudinal direction of the strip 52 being parallel to the direction of slitting. Alternatively, strips 52 may be formed by dividing a coil into sheets which are then slit longitudinally or transversely into strips 52.

During the method of the invention, the strip 52 is severed in the transverse direction at one or more points to form a plurality of blanks 53, each of which has a length, measured in the longitudinal direction, which is substantially the same as the length of plate 10.

Another preferred method of the invention begins by providing a sheet metal blank 53 having a width the same as that of strip 52 and having a length which is substantially the same as that of plate 10. The blanks 53 may preferably be formed as described above by transversely severing strips 52 of indefinite length. Where the length of the blank 10 is the same as the width of the sheet metal coil, the blanks 53 may be formed by cutting transversely across the width of the coil. Where the length of the blank 53 is somewhat greater than the width of the coil, the blanks 53 may be formed by slitting the coil diagonally, that is with the side edges 54 of the strip 52 being angled relative to the transverse direction of the coil.

Figure 4:
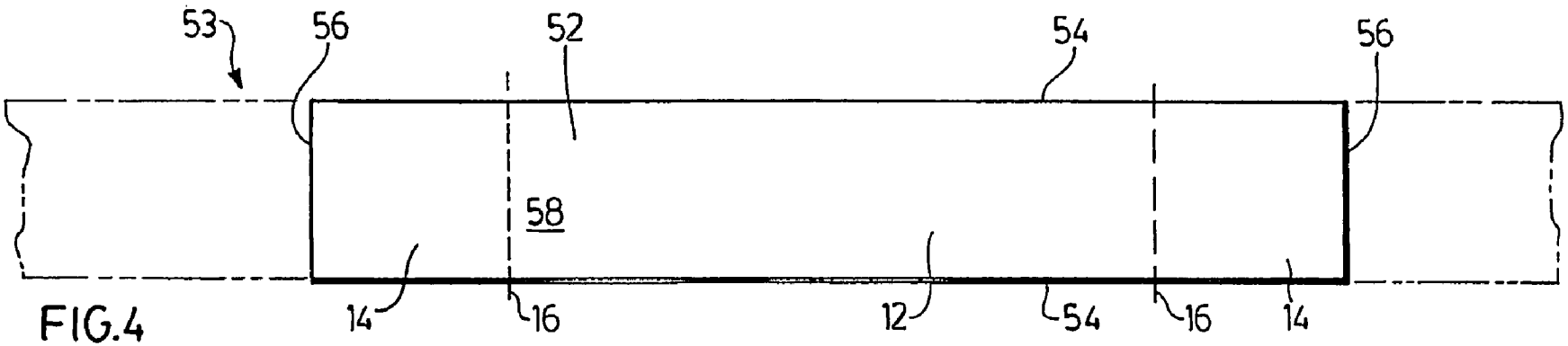
FIG. 4 is a top plan view of a strip or blank from which the plate of FIG. 1 is formed.
Figure 5:
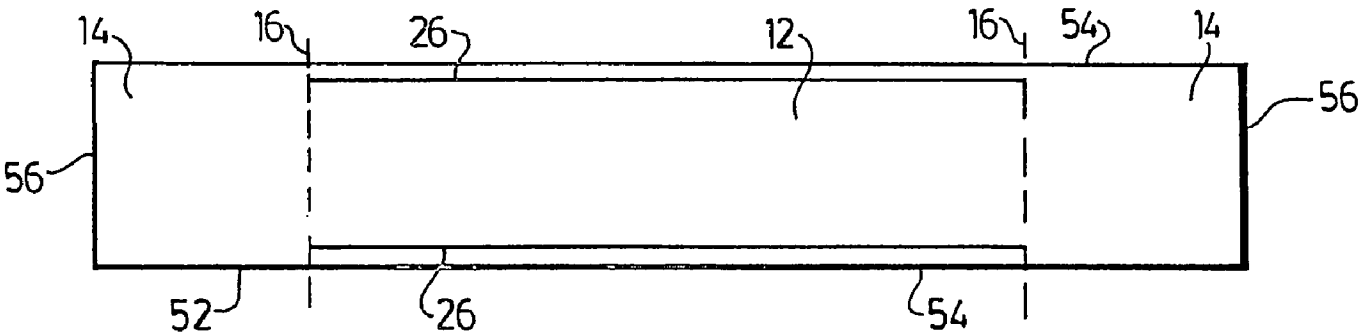
FIG. 5 is a top plan view of the blank of FIG. 4, after formation of the flow channel.
Figure 6:
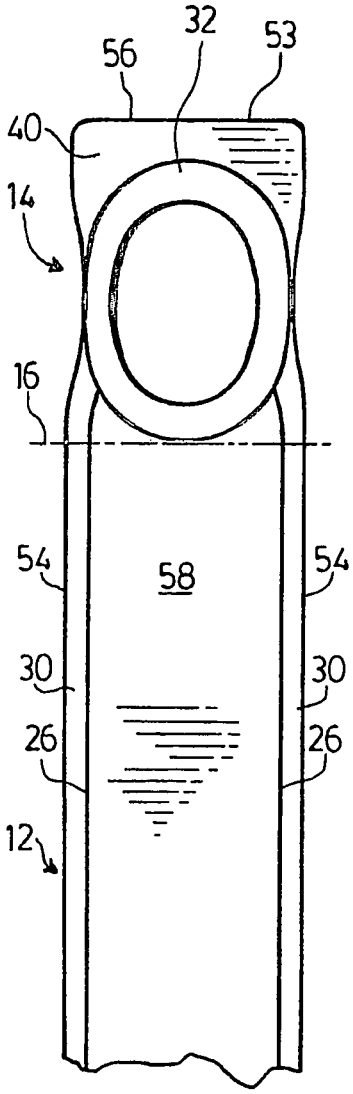
FIG. 6 is a top plan view of the blank of FIG. 5, after a first boss stamping step.
Figure 7:
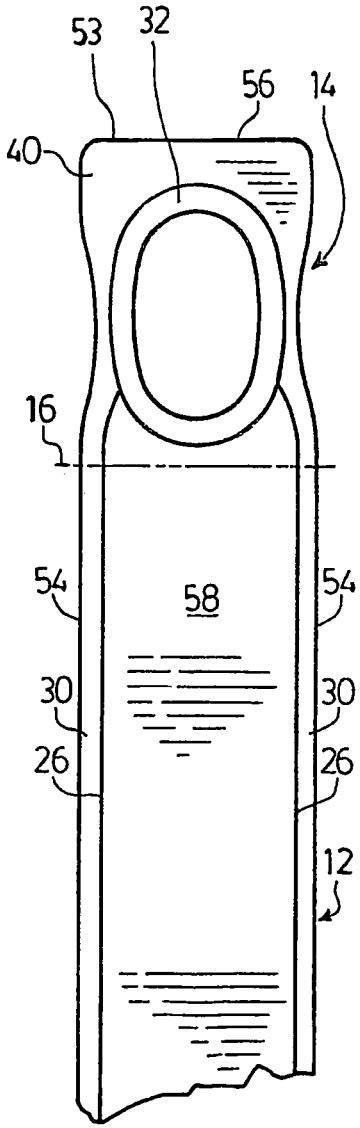
FIG. 7 is a top plan view of the blank of FIG. 6, after a second boss stamping step.
Figure 8:
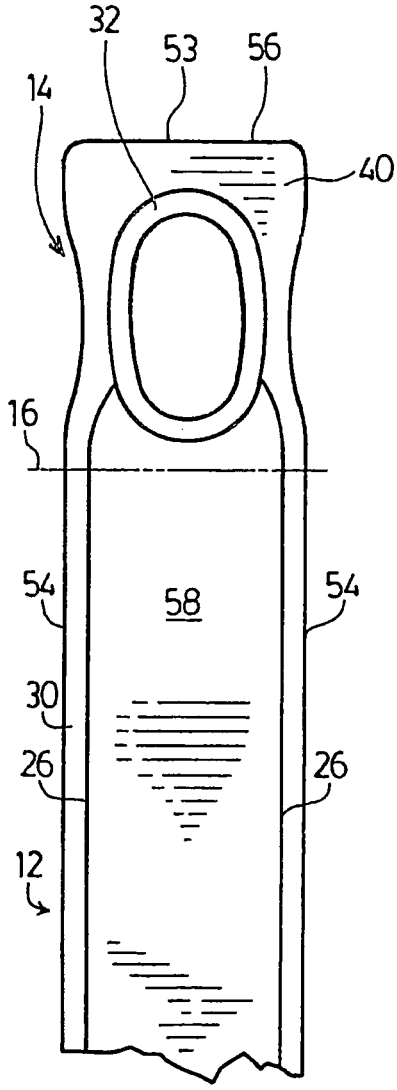
FIG. 8 is a top plan view of the blank of FIG. 7, after a third boss stamping step.

Except as otherwise indicated, the method now described below begins with a blank 53 having a length and a width which are substantially the same as the length and width of the plate 10. However, to indicate that the method may begin with the provision of either a strip 52 or a blank 53, FIG. 4 illustrates (in dotted lines) portions of strip 52 extending beyond the end edges 56 of blank 53. In addition, FIGS. 4 and 5 show the central portions 12, end portions 14 and the dotted lines 16 separating the central and end portions 12 and 14.

The next step in the method comprises the formation of the fluid flow channel 28, preferably by formation of shoulders 26 along the side edges 54 of the blank 53. Preferably, as shown in FIG. 5, the shoulders 26 terminate so as not to substantially extend into the end portions 14. As shown in FIG. 5, it may be preferred to terminate the shoulders 26 at or near the line 16 dividing the central portion 12 from the end portions 14. The termination of shoulders 26 is preferred so that the shoulders do not interfere with formation of a flat end flange 40 in the end portion of plate 10.

It will be appreciated that the formation of shoulders 26 provides each plate 10 with a single, longitudinally extending flow channel 28, with side flanges 30 extending along either side of the flow channel 28. The plates 10 may, however, be of more complex configuration and may be formed with more than one flow channel, although all configurations would be formed with flanges adjacent the side edges 54, and a raised central portion forming the flow channel(s).

As mentioned above, the width of strip 52 or blank 53 is substantially the same as the width of plate 10. As used herein with reference to the width of plate 10, the term "substantially the same" is intended to mean that the width of strip 52 or blank 53, measured transversely across the central portion 12 thereof, after formation of flow channel 28, is the same as the width of the plate 10, measured transversely across the central portion 12 thereof, such that no edge trimming of the plate 10 is required. It will be appreciated that the width of the strip 52 or blank 53, prior to formation of the flow channel 28, will be slightly greater than the width of plate 10 since the material required for formation of the shoulders 26 will be drawn from the width of the strip 52 or blank 53.

It will be appreciated that, where the method begins by provision of a strip 52 of indefinite length, the shoulders 26 may be roll-formed prior to severing the strip 52 into individual blanks 53. Of course, the shoulders 26 may also be formed by stamping the strips 52 or blank 53 with an appropriate die.

The next step in the method comprises formation of the raised bosses 32 in each of the end portions 14 of strip 52 or blank 53. The bosses 32 are formed by a plurality of successive stamping or drawing operations, with the degree of boss formation in each successive stamping operation being illustrated in FIGS. 6 to 9. As can be seen from the drawings, some of the material from which the bosses 32 are formed is drawn from the surrounding material of the strip 52 or blanks 53. This results in material of the end portions 14 becoming drawn inwardly toward the bosses 32. This is apparent from FIGS. 6 to 9 which show the side edges 54 of the strip 52 or blank 53 converging inwardly toward one another along the sides 34 of the bosses 32.

In the most preferred embodiments according to the invention, it is preferred that the strips 52 are severed into blanks 53 prior to formation of bosses 32, and that the bosses 32 are formed by successive stamping operations by pairs of dies. The dies are preferably mounted in an apparatus in such a manner that the distance between the dies can be adjusted, thereby permitting the formation of plates having various lengths, which is not possible in progressive stamping dies.

It will be appreciated that the length, width and height of the bosses 32 are selected such that the heat exchanger formed by pairs of plates 10 will have a desired flow through its headers, such that a desired spacing will be maintained between the plate pairs to allow insertion of cooling fins, and such that the bosses 32 may be formed within the width dimension of the strip 52 or blank 53, thereby avoiding the need to trim excess material from the edges of the plate 10.

After formation of the bosses 32, the next step in the method comprises the formation of apertures 42 in bosses 32, for example using a cutting die.

Figure 9:
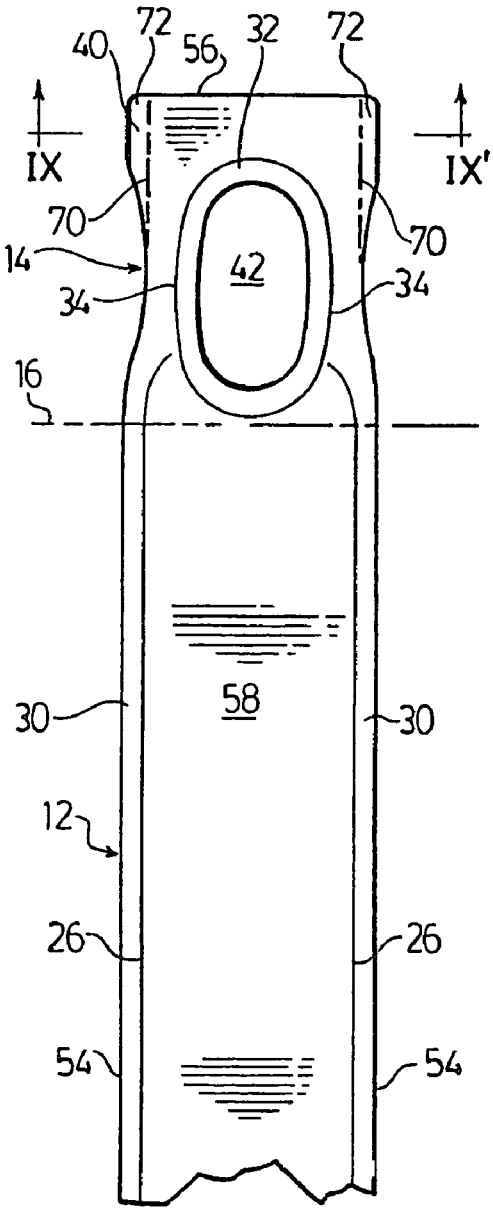
FIG. 9 is a top plan view of the blank of FIG. 8, after a fourth boss stamping step.
Figure 10:
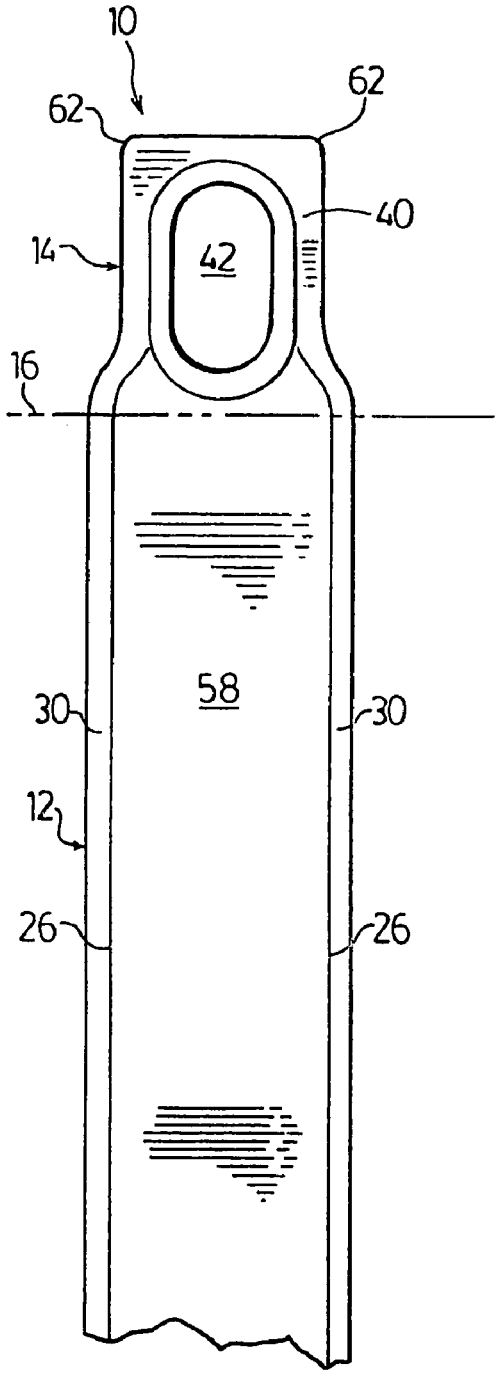
FIG. 10 is a top plan view of the blank of FIG. 9, after formation of the apertures in the bosses and optional trimming of the end flange.

As shown in FIG. 9, there may be some excess material located between the distal end 38 of the bosses 32 and the end edges 24 of the plate 10. Although not essential, some of this material may be removed by trimming, for example to provide smoothly rounded edges 62 as shown in FIG. 10, while maintaining an end flange 40 of sufficient dimensions to allow leak-free formation of the plate pairs, for example by brazing.

As mentioned above, the length of the blank 53 is substantially the same as the length of plate 10. As used herein with reference to the length of plate 10, the term "substantially the same" is intended to mean that the total length of blank 53, measured longitudinally between end edges 56, after formation of bosses 32, is the same as the total length of plate 10, before end trimming as described in relation to FIG. 10. It will be appreciated that the length of the blank 53, prior to formation of the bosses 32, will be slightly greater than the length of plate 10, before end trimming, since the formation of bosses 32 will somewhat reduce the length of the blank 53.

Figure 11:
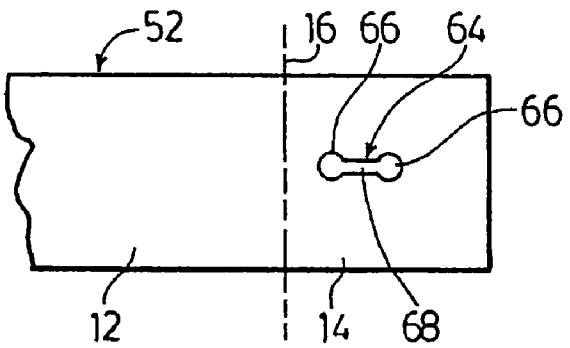
FIG. 11 illustrates an alternate blank according to the invention having apertured end portions.

As can be seen from FIGS. 6 to 9, the end flanges 40 of plate 10 reach their narrowest points adjacent the edges 34 of bosses 32, due to the fact that much of the material from which the bosses 32 are formed is drawn inwardly from the surrounding portions of the strip 52 or blank 53. Excessive narrowing of the flange 40 in these regions results in narrowing of the surfaces along which the plate pairs are formed, possibly affecting the reliability of joint formation in this area, and limiting the width dimensions of the bosses 32. To avoid excessive narrowing of flange 40 in this region, the strips 52 or blanks 53 may preferably be provided with apertures 64 in the end portions 14. These apertures 64 are centrally located in the areas of end portions 14 which will be cut out to form the flow apertures 42 of bosses 32. During formation of bosses 32, some of the material required for formation of the bosses 32 will be drawn outwardly from apertures 64 in the direction of the arrows in FIG. 11, thereby reducing the amount of material which is drawn from the area surrounding the bosses 32.

In the preferred embodiment of the invention, in which the bosses 32 and apertures 42 are oval in shape, the apertures 64 are preferably also elongated in the longitudinal direction. In the particularly preferred embodiment shown in FIG. 11, the apertures 64 may be dumbbell-shaped, comprising a pair of circular apertures 66 joined by a longitudinal slit 68.

Figure 12:
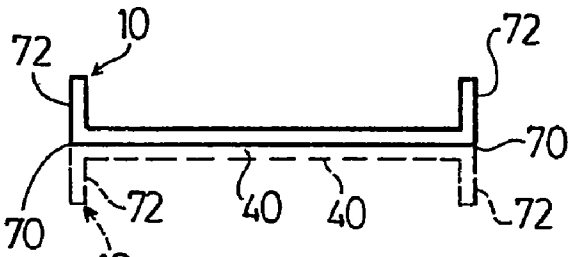
FIG. 12 is a cross section of an alternate preferred plate according to the invention, taken along line IX-IX' of FIG. 9.

Rather than trimming the end flange 40 as shown in FIG. 10, the flanges 40 may be bent along lines 70 shown in FIG. 9 to form tabs 72. The lines 70 are parallel to the longitudinal axis and are substantially tangential with the curve defined by the inwardly curved portion of flange 40, which is located proximate the sides 34 of bosses 32. As shown in FIG. 12, the tabs 72 preferably extend at right angles to the remainder of flange 40, and are preferably both bent upwardly. Thus, when the plates 10 are combined to form plate pairs, the ends of the plate pair have an H-shaped cross section, having tabs 72 extending both upwardly and downwardly from flanges 40. The configuration of the tabs 72 in a plate pair 74 is also illustrated in FIG. 12, with a second plate 10 being illustrated in dashed lines.

When the plate pairs 74 are stacked to form a heat exchanger, the tabs 72 will extend into the space between the plates 10. In some preferred embodiments, the tabs 72 of adjacent plate pairs 74 are of sufficient height to abut one another, and may become connected to one another during brazing of the heat exchanger, thus providing an additional brazed connection between the plates 10. In other preferred embodiments, the tabs are of lesser height, such that the tabs 72 of adjacent plate pairs do not contact one another. Where the tabs 72 of adjacent plate pairs do not engage one another, they serve to provide a plurality of surfaces to which a heat exchanger mounting bracket may be secured. Of course, a mounting bracket can also be secured to the tabs 72 in the embodiment where the tabs of adjacent plate pairs 74 abut one another.

Figure 13:
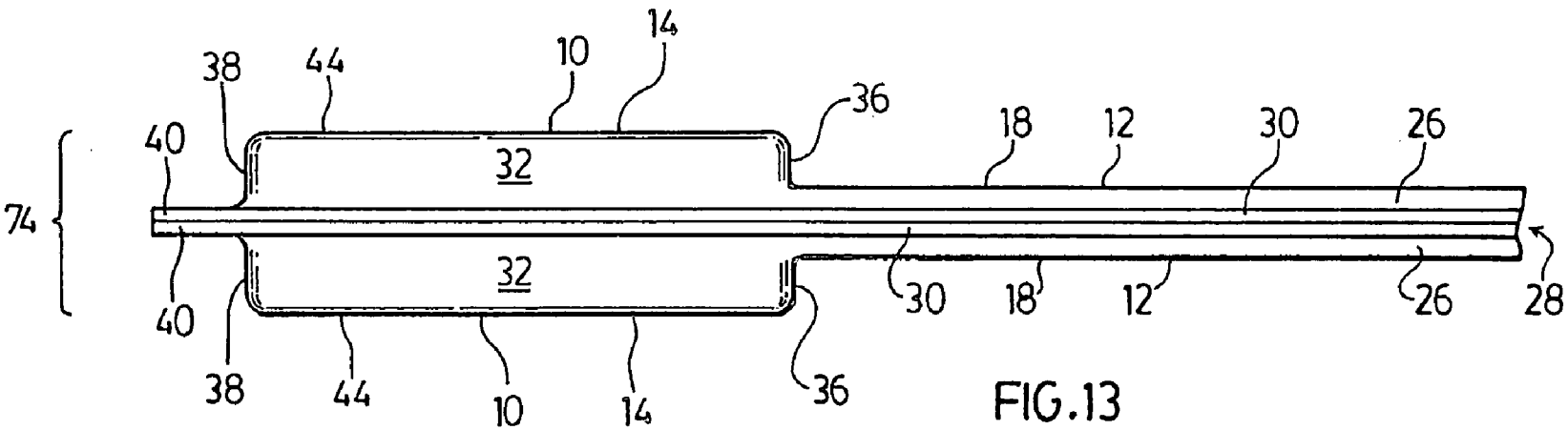
FIG. 13 is a side view of one end of a plate pair formed from a pair of plates shown in FIG. 1.

FIG. 13 is a side view showing one end of a preferred plate pair 74 which is formed by joining a pair of plates 10 in back-to-back relation, such that the flanges 30 and 40 of the plates 10 engage one another and are joined in a leak-free manner, such as by brazing.

Although the method according to the invention has been described as including formation of the flow channel prior to formation of the bosses, it is to be appreciated that this sequence of steps is preferred, but not essential. In other preferred embodiments, the bosses may be formed prior to formation of the flow channel. However, it may be preferred to form the flow channel first since the channel form improves the rigidity of the blank, thereby reducing its tendency to bend or twist, and possibly resulting in improved accuracy of the boss stamping operation.

In some preferred methods of the invention, the channel 28 of plate 10 is formed by stamping the strip 52 or blank 53 with a single channel-forming die which is of fixed length and which is stationary relative to the longitudinal axis of strip 52 or blank 53. The bosses 32 are then formed by a plurality of dies which may preferably be movable relative to the longitudinal axis. This type of arrangement may permit a limited amount of variation in the length of plate 10 (as further described below with reference to FIGS. 23 to 32). However, where it is necessary to accommodate large variations in the length of plate 10, replacement of the channel-forming die by another die of different length would be required. The relative positions of the boss-forming dies would then be adjusted for compatibility with the new channel length.

In order to minimize tooling costs, the present invention provides methods which allow the channel length to be easily varied without replacement of the channel-forming die. A preferred embodiment of such a method is described below with reference to FIGS. 14 to 22, which illustrates a method in which the channel 28 is formed by one or more stamping operations involving the use of a channel-forming die 80 which is movable along the longitudinal axis of the strip 52 or blank 53, thereby permitting variation of the channel length for production of plates 10 having lengths within a predetermined range.

Each stamping operation using an axially movable channel-forming die 80 produces a channel segment having a length which is equal to or less than the total length of the channel 28. For example, where the desired plate length is at the lower limit of the predetermined range, the channel 28 is preferably formed by one stamping operation using an axially movable channel-forming die 80, wherein the length of the channel segment produced by the axially movable channel-forming die 80 is equal to the total length of the channel 28.

On the other hand, where the desired plate length is above the lower limit of the predetermined range, the channel 28 will be formed by two or more stamping operations, at least one of which involves the use of a movable channel-forming die 80. In this case, the length of the channel segment produced by the axially movable channel-forming die 80 will be less than the total length of the channel 28. It will be appreciated that the two or more stamping operations could be performed by a single axially movable channel-forming die 80, by two or more axially-movable channel forming dies 80, or by an axially movable channel-forming die 80 in combination with a stationary channel-forming die.

In the particular method illustrated by FIGS. 14 to 22, the desired length of channel 28 is greater than the lower limit of the predetermined range, such that multiple stamping operations are required to form channel 28. In this preferred embodiment, at least one of the stamping operations is performed by an axially movable channel-forming die 80. This preferred method is now described in detail below.

The method illustrated in FIGS. 14 to 21 begins with a blank 53 which has a width and length substantially the same as that of plate 10 as described above. As in FIG. 4, the blank 53 has an elongate central portion 12 located between a pair of end portions 14, with the approximate boundaries between central portion 12 and end portions 14 being indicated by dotted lines 16. The blank 53 is fed to an apparatus 78 comprising one or more axially movable channel-forming dies 80, each of which comprises an upper die portion 82 and a lower die portion 84.

Figure 14:
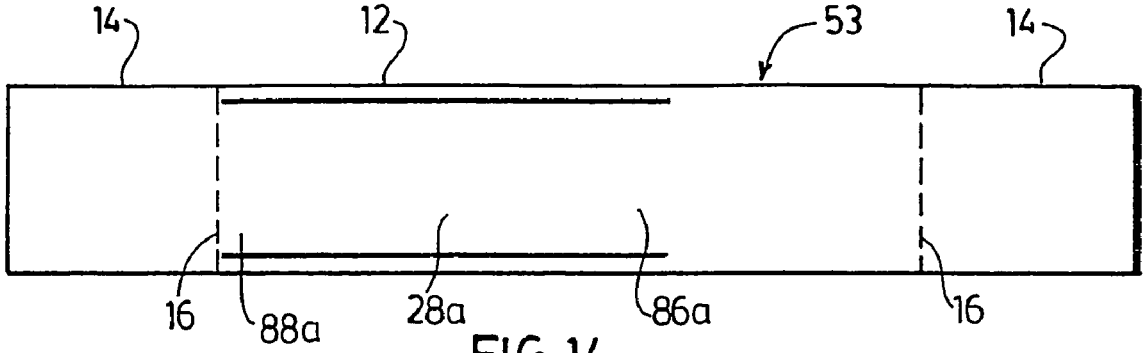
FIGS. 14 and 15 are top plan views of blanks after formation of channel portions according to a preferred method according to the invention.
Figure 16:
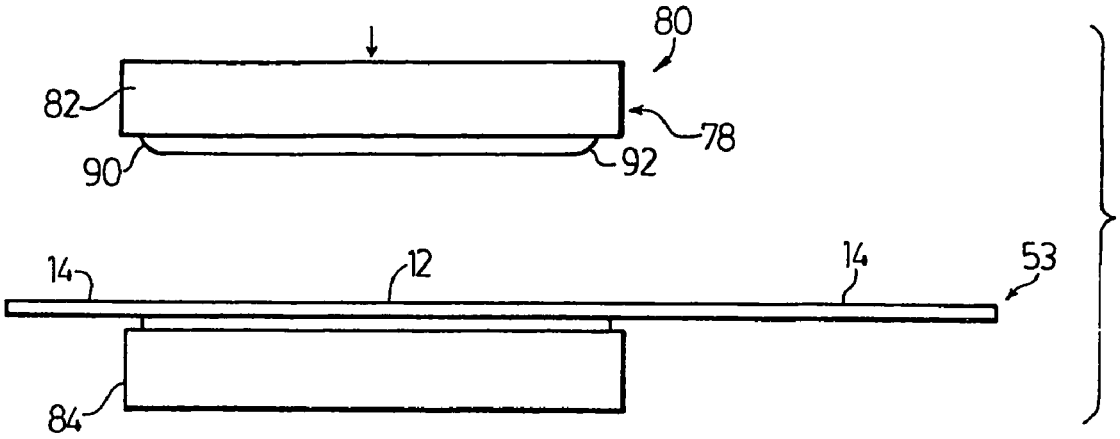
FIGS. 16 to 21 are schematic side views showing the formation of the channel portions in the blanks of FIGS. 14 and 15.
Figure 17:
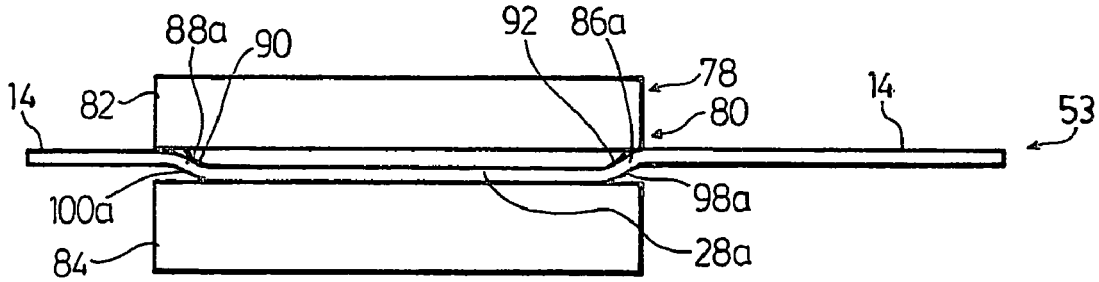

As shown in FIGS. 16 and 17, the upper and lower die portions 82 and 84 are closed on the blank 53 to form a first channel portion **28*a* having a proximal end portion 86*a* and a distal end portion 88*a*, shown in FIG. 14. The distal end portion 88*a* terminates at or near the boundary 16 between the central portion 12 and one of the end portions 14 of the blank 53**.

Figure 18:
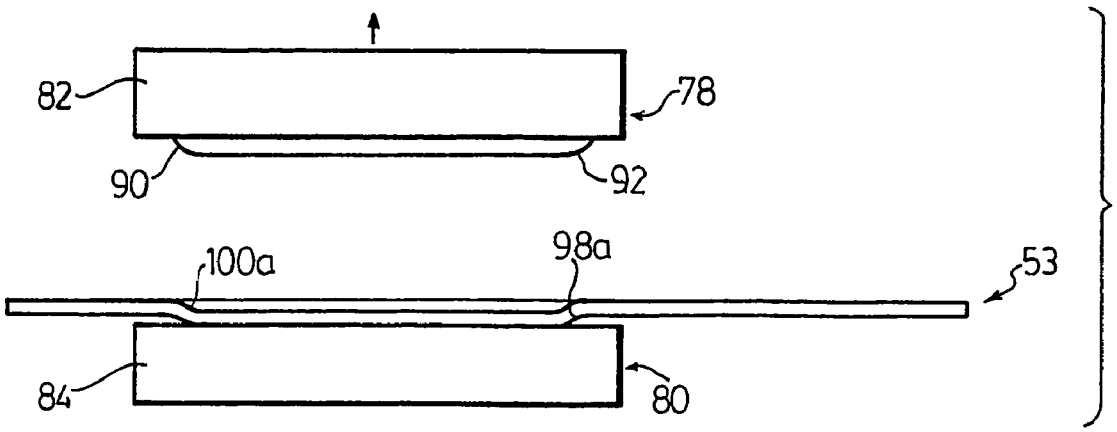

Following formation of the first channel portion **28*a*, the die portions 82 and 84 are opened as in FIG. 18. As shown in FIGS. 16 to 21, the opposite ends 90, 92 of upper die portion 82 are rounded or tapered. This provides the proximal and distal end portions 86*a*, 88*a* of first channel portion 28*a* with gradual terminations 98*a*, 100*a* which may either be rounded or tapered, thereby avoiding damage to the blank 53. In the drawings, the terminations 98*a* and 100*a*** are shown as being rounded and are exaggerated so as to be clearly visible.

Figure 15:
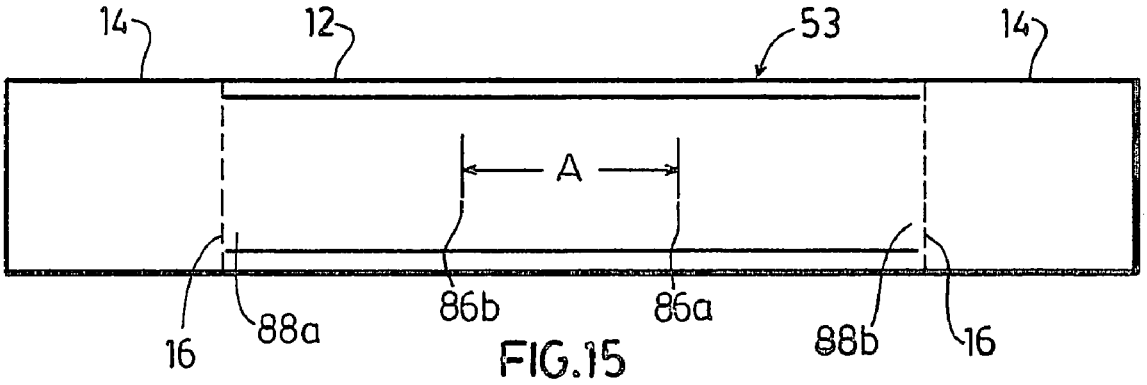

The next step in the method comprises formation of a second channel portion **28*b* which, as shown in FIG. 15, comprises a proximal end portion 86***b* and a distal end portion 88*b*, with the distal end portion 88*b* terminating at or near the boundary 16 between the central portion 12 and one of the end portions 14 of the blank 53. It can be seen from FIG. 15 that the proximal end portion 86*a* of the first channel portion 28*a* and the proximal end portion 86*b* of the second channel portion 28*b* overlap one another by an amount A, and that the distal end portions 88*a* and 88*b* are spaced from one another along the longitudinal axis by an amount which is preferably equal to the desired length of channel 28.

The second stamping operation may preferably be performed by the same die 80 which performed the first stamping operation illustrated in FIGS. 16 to 18. In this case, the blank 53 preferably remains stationary during the formation of channel 28, while the single channel-forming die 80 is displaced axially between the first and second stamping operations.

Figure 22:
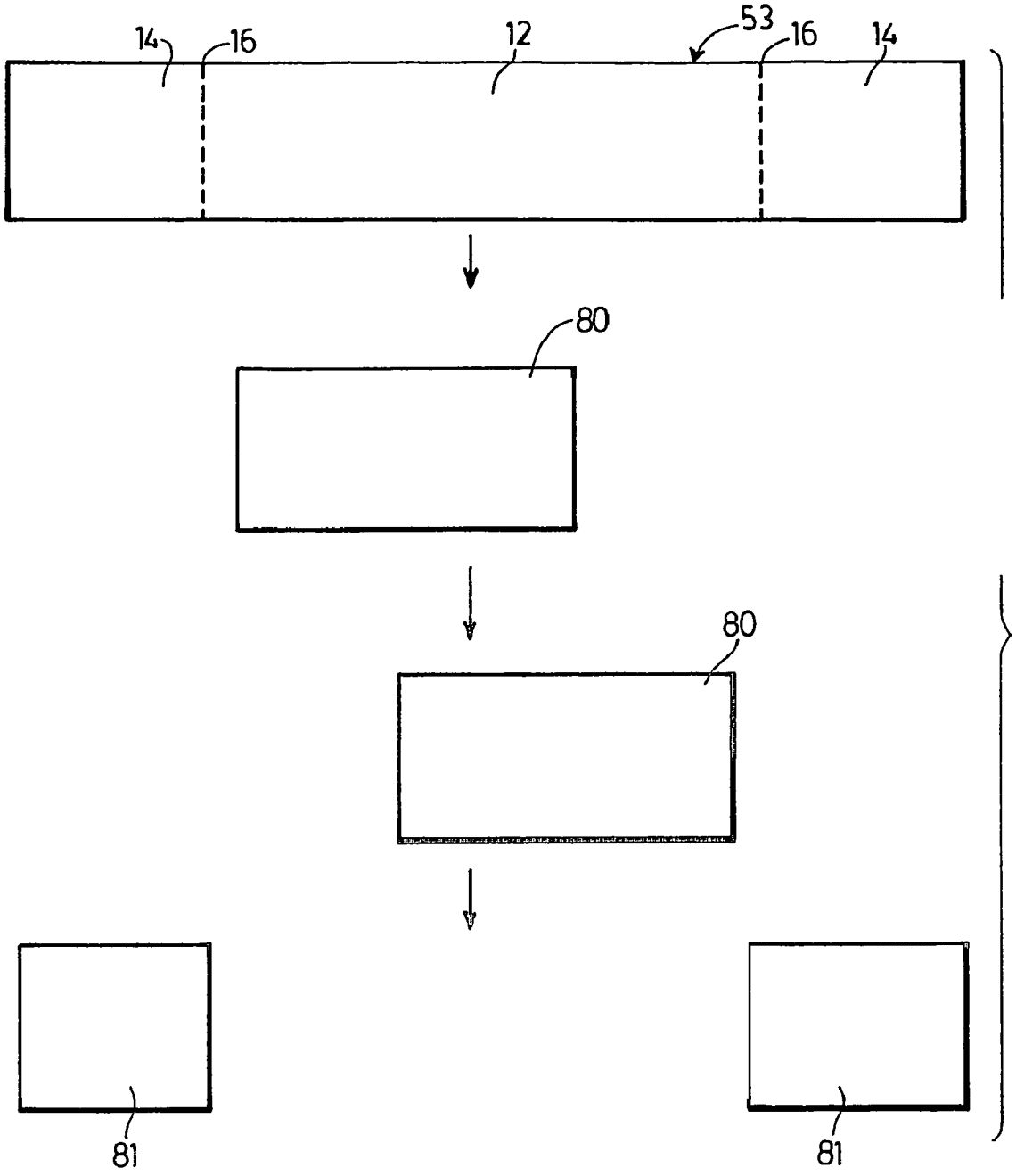
FIG. 22 schematically illustrates the steps in the method of FIGS. 14 to 21.

In the alternative, as shown in FIGS. 19 to 22, the first and second stamping operations may be performed by different channel-forming dies 80. Although the dies 80 may be axially aligned relative to one another, they are shown in FIG. 22 as being located at different stamping stations which are transversely spaced from one another such that the blank 53 must be moved transversely between the first and second stamping operations.

Although dies 80 are described above as being axially movable, it will be appreciated that one of the dies 80 used to form the first channel portion 28*a* and the second channel portion 28*b* could be stationary with respect to the longitudinal axis of blank 53.

Figure 19:
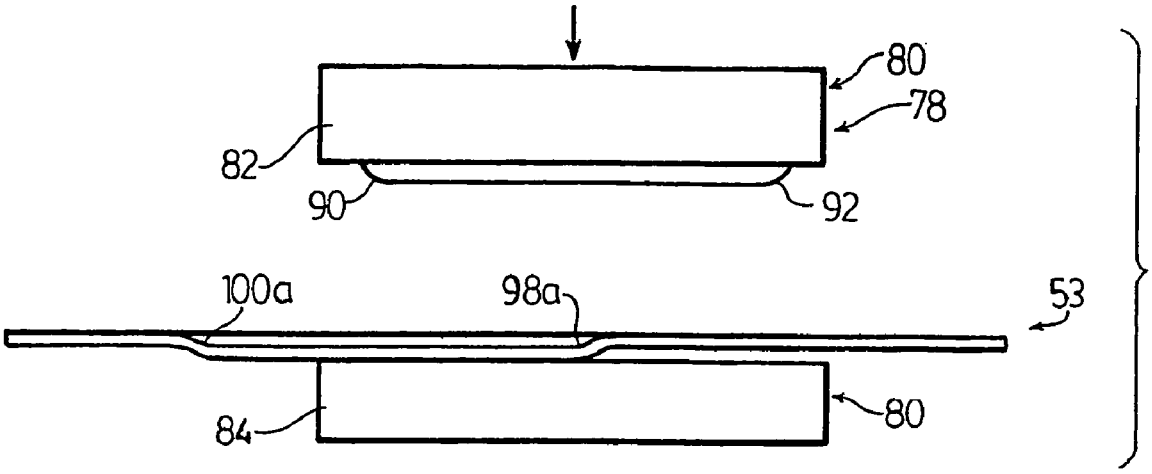
Figure 20:
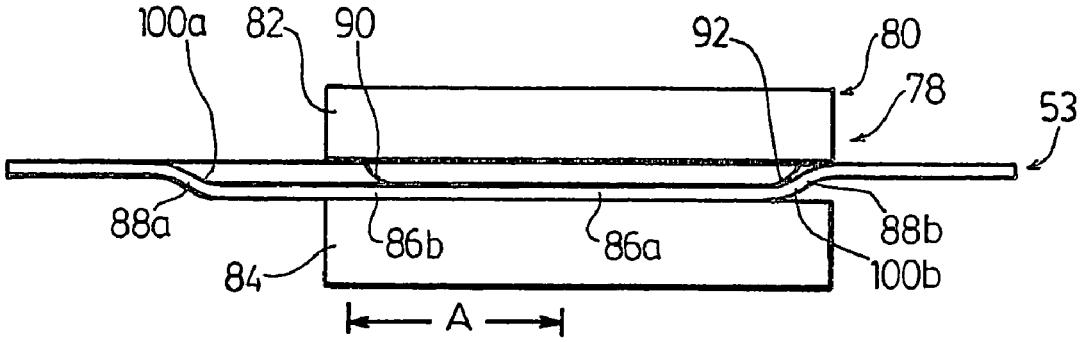
Figure 21:
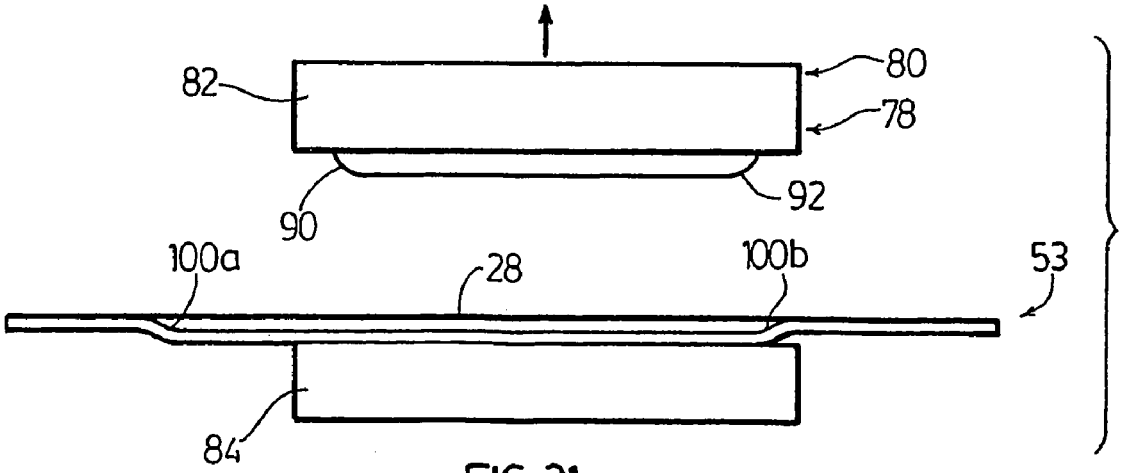

The upper die portion 82 of channel-forming die 80 used in the second stamping operation shown in FIG. 19 also has rounded or tapered ends 90, 92 so as to provide the second channel portion 28*b* with a gradual termination 100*b* at the distal end portion 88*b*. Due to the overlap of the proximal end portions 86*a* and 86*b*, no gradual termination 98*b* will be seen at the proximal end portion 86*b* of the second channel portion 28*b*. Nor is the terminal end portion 98*a* of the first channel portion 28*a* visible after the second stamping operation. Rather, the proximal end portions 86*a* and 86*b* will blend smoothly together to form a channel 28 of substantially uniform cross section.

As mentioned above, at least one of the channel-forming dies 80 is movable along the longitudinal axis so as to vary the area of overlap A. In order to ensure that the channel 28 is of constant cross section, it is necessary that the proximal end portions 86*a* and 86*b* overlap to an extent sufficient that the gradual terminations 98*a* and 98*b* are not present in the channel 28. In most preferred embodiments of the invention, at least about 1 inch of overlap will be required to ensure that the channel 28 is of constant cross-section.

Following the channel stamping operations shown in FIGS. 14 to 21, the formation of plate 10 is completed by formation of the raised bosses 32 as described above with reference to FIGS. 6 to 10. As shown in FIG. 22, the bosses may be formed simultaneously by axially-aligned boss-forming dies 81, both of which are preferably movable relative to the longitudinal axis. It will, however, be appreciated that the boss-forming dies 81 may be transversely spaced from one another and that the formation of each of the bosses 32 will typically require multiple stamping operations performed by multiple pairs of boss-forming dies 81.

Another preferred variation of the method according to the invention is illustrated in FIGS. 23 to 32. In this variation of the method, a blank 53 is provided as in the previous embodiments having a width and length substantially the same as that of plate 10, and having an elongate central portion 12 located between a pair of end portions 14, with the approximate boundaries between central portion 12 and end portions 14 being indicated by dotted lines 16. The blank 53 is fed to an apparatus 102 comprising a channel-forming die 104 having an upper die portion 106 and a lower die portion 108. In this embodiment, a first channel portion 110 is formed having end portions 112 and 114. The first channel portion 110 has a length which is somewhat less than the length of the channel 28, such that at least one of its end portions is spaced from the approximate boundary 16 between the central portion 12 and the end portions 14 of the blank 53. In the preferred embodiment shown in the drawings, both end portions 112, 114 of the channel portion 110 are spaced from lines 16.

The channel-forming die 104 may either be movable along the longitudinal axis or may be stationary. In the preferred embodiment shown in FIGS. 25 to 27, the channel-forming die 104 is stationary. If desired, the stationary channel die 104 may be replaced by die(s) 80 as described above such that the first channel portion 110 is formed in two separate stamping operations.

Figure 23:
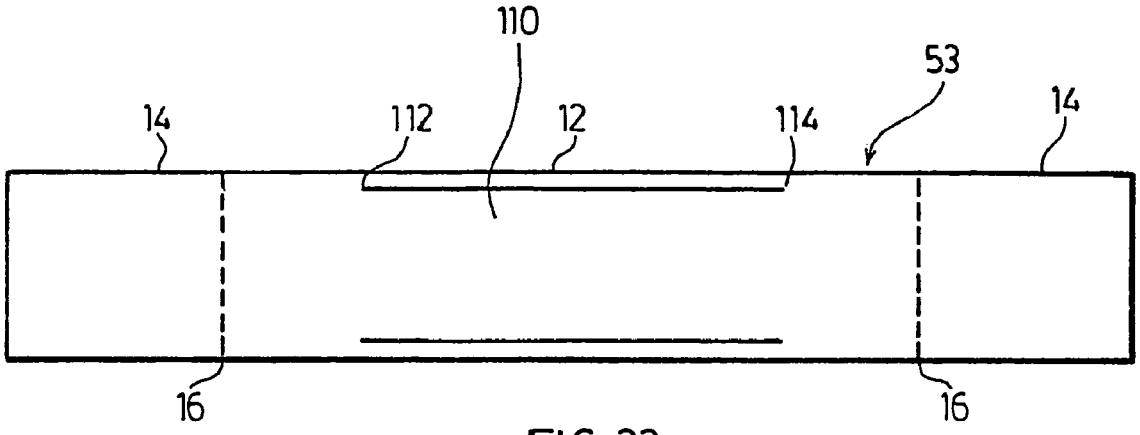
FIGS. 23, 24 and 31 are top plan views of blanks after formation of channel portions and raised bosses by another preferred method according to the invention.

As in the previously described embodiment, the upper die portion 106 of channel-forming die 104 preferably has opposite ends 116, 118 which are rounded or tapered. As shown in FIG. 23, the curvature of the upper die portion 106 provides the end portions 112, 114 of the first channel portion 110 with gradual terminations 120, 122, thereby avoiding damage to the blank 53. As in the embodiment described above, the curvature of ends 116, 118 is exaggerated in the drawings.

Figure 24:
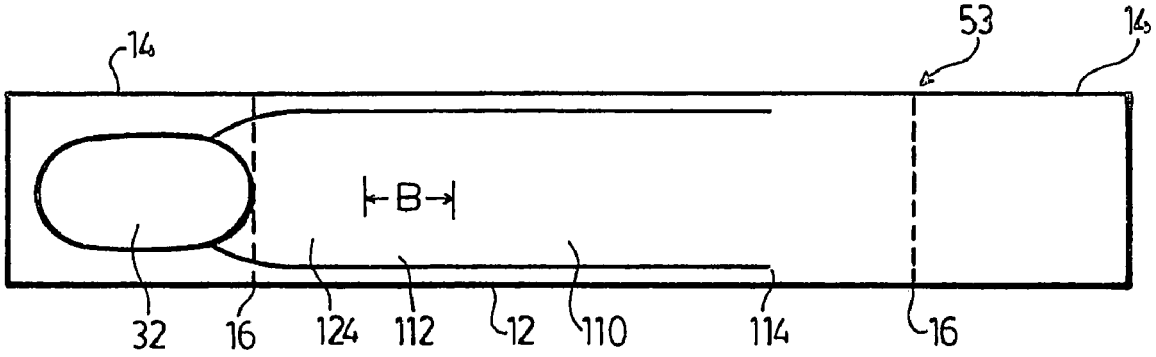
Figure 25:
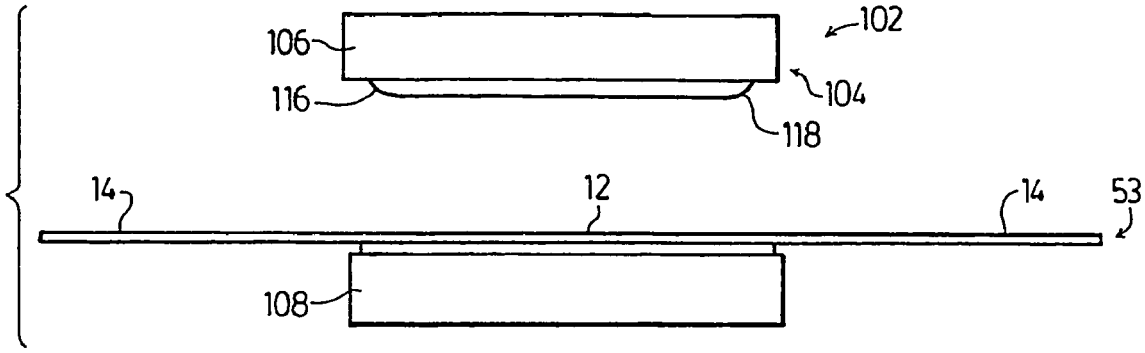
FIGS. 25 to 30 are schematic side views showing the formation of channel portions and raised bosses in the blanks of FIGS. 23, 24 and 31.
Figure 26:
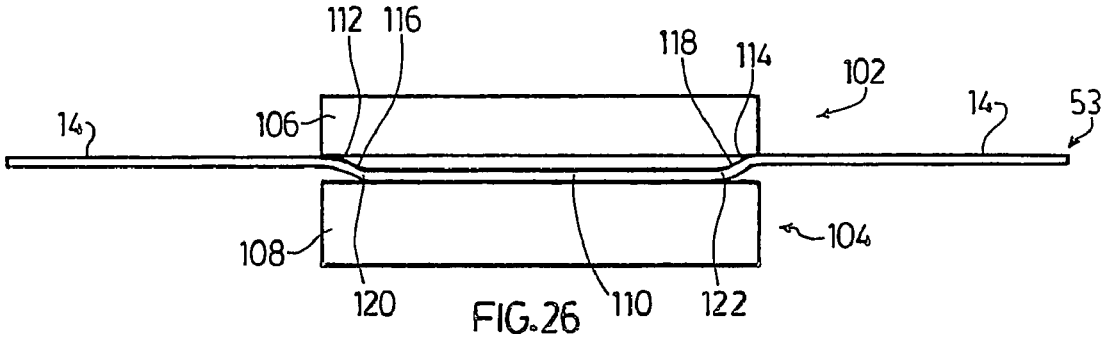
Figure 27:
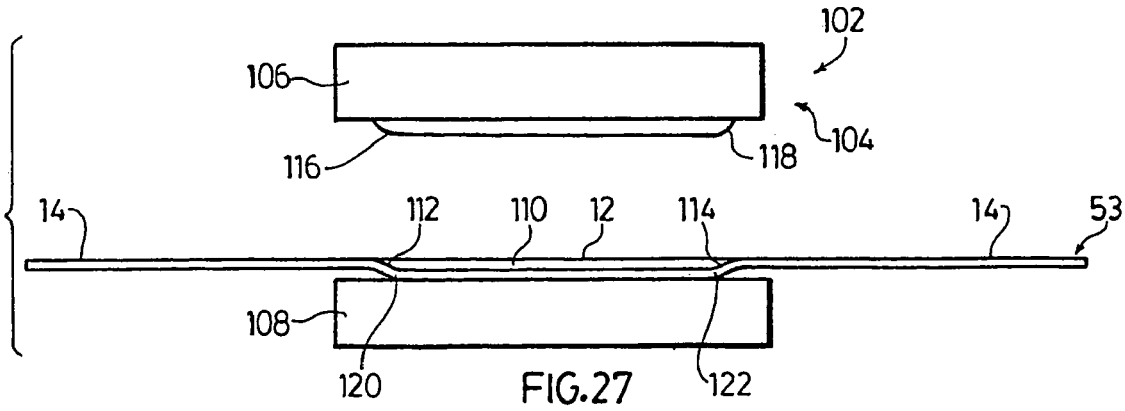
Figure 28:
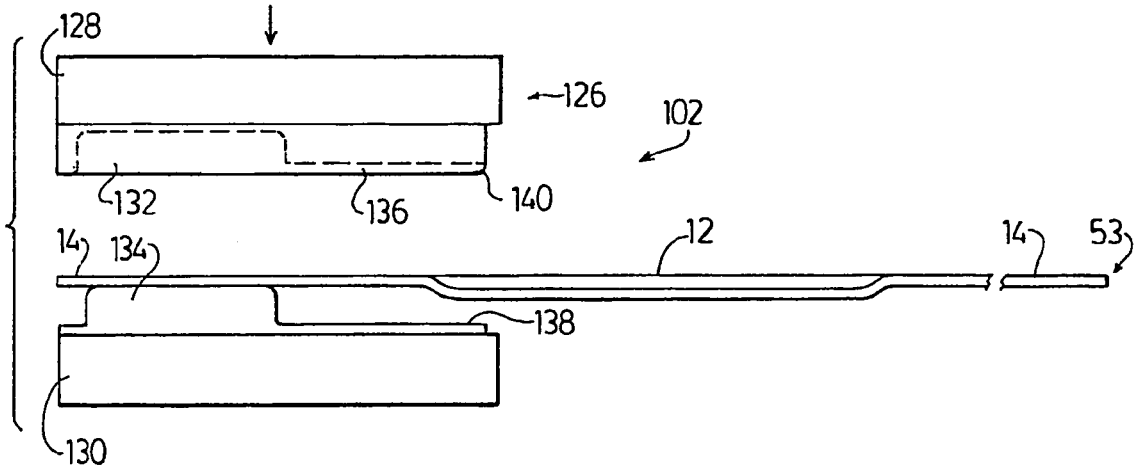
Figure 29:
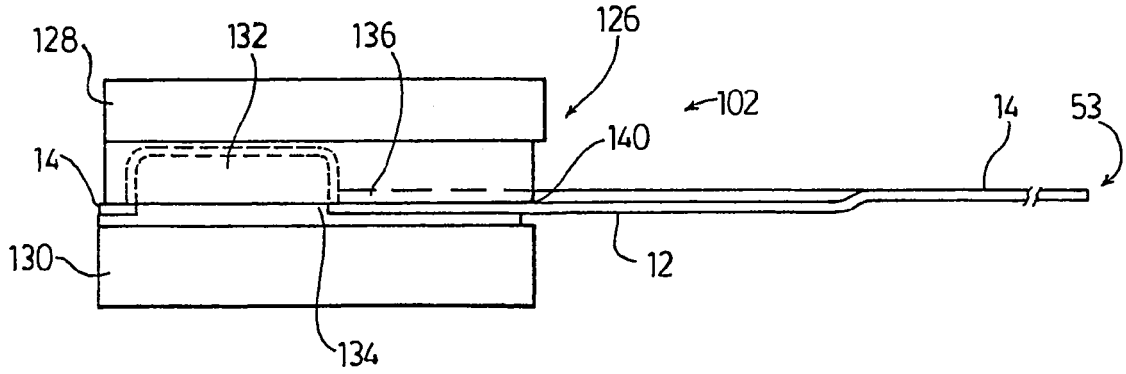

The next step in the method, illustrated in FIGS. 24, 28 and 29, comprises formation of a second channel portion 124 and a first one of the raised bosses 32, the channel portion 124 and the first boss 32 being formed together by stamping the blank 53 with a combined die 126 having an upper die portion 128 and a lower die portion 130. The upper and lower die portions 128, 130 have boss-forming portions 132, 134 for forming the boss, and also have channel-forming portions 136, 138 for forming the second channel portion 124. The terminal end 140 of the channel-forming portion 136 of the upper die portion 128 is preferably smoothly rounded or tapered to blend the first and second channel portions 110, 124.

As shown in FIG. 24, the end portion 112 of the first channel portion 110 and the second channel portion 124 overlap one another by an amount B which is variable depending on the desired length of the plate 10. Preferably, the combined die 126 is movable along the longitudinal axis to vary the amount of overlap B and thereby vary the length of the plate 10. In order to ensure that the channel 28 is of a substantially uniform cross section, the amount of overlap is sufficient to ensure that rounded terminations of the first and second channel portions 110, 124 are not present in the channel. Preferably, as mentioned above, the amount of overlap B is at least about 1 inch.

As shown in FIGS. 6 to 10, it will be appreciated that more than one operation is typically required to form the bosses 32. In the preferred embodiment using combined die 126, at least one of the boss forming operations will be performed by a combined die 126, with one or more of the boss-forming operations optionally being performed by die(s) which have only a boss-forming portion.

Figure 30:
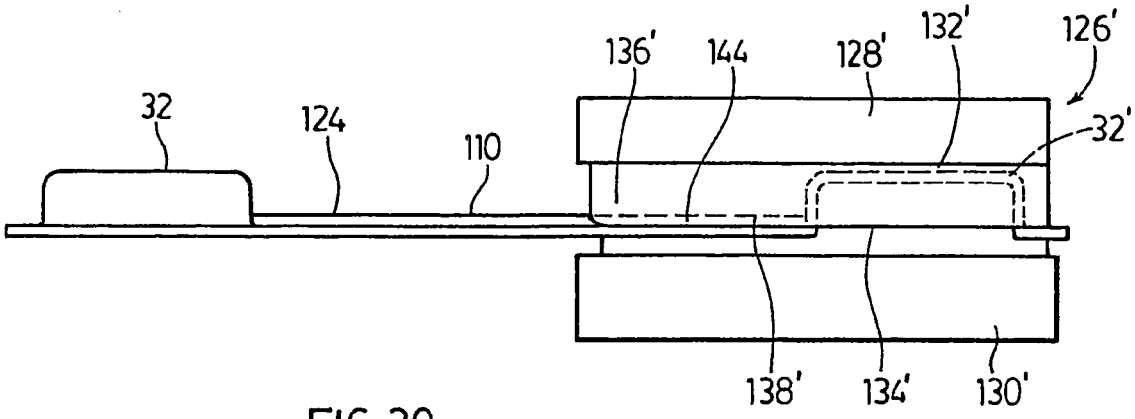
Figure 31:
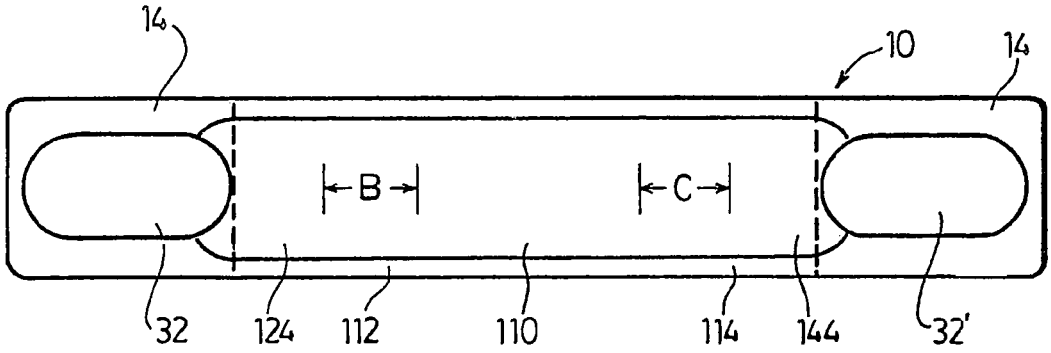

The partially finished plate 10 shown in FIG. 24 is then subjected to a third stamping operation, shown in FIG. 30, in which a third channel portion 144 and a second boss 32' are formed together by stamping the partially finished plate 10 with a combined die 126' which is preferably an identical mirror image of combined die 126. Combined die 126' has an upper die portion 128' with a boss-forming portion 132' and a channel-forming portion 136', and has a lower die portion 130' with a boss-forming portion 134' and a channel-forming portion 138'. As shown in FIG. 31, the end portion 114 of the first channel portion 110 overlaps the third channel portion 144 by an amount C which is variable depending on the desired length of the plate 10, and is preferably at least about 1 inch. Preferably, the combined die 126' is movable along the longitudinal axis to vary the amount of overlap C and thereby vary the length of the plate 10.

Figure 32:
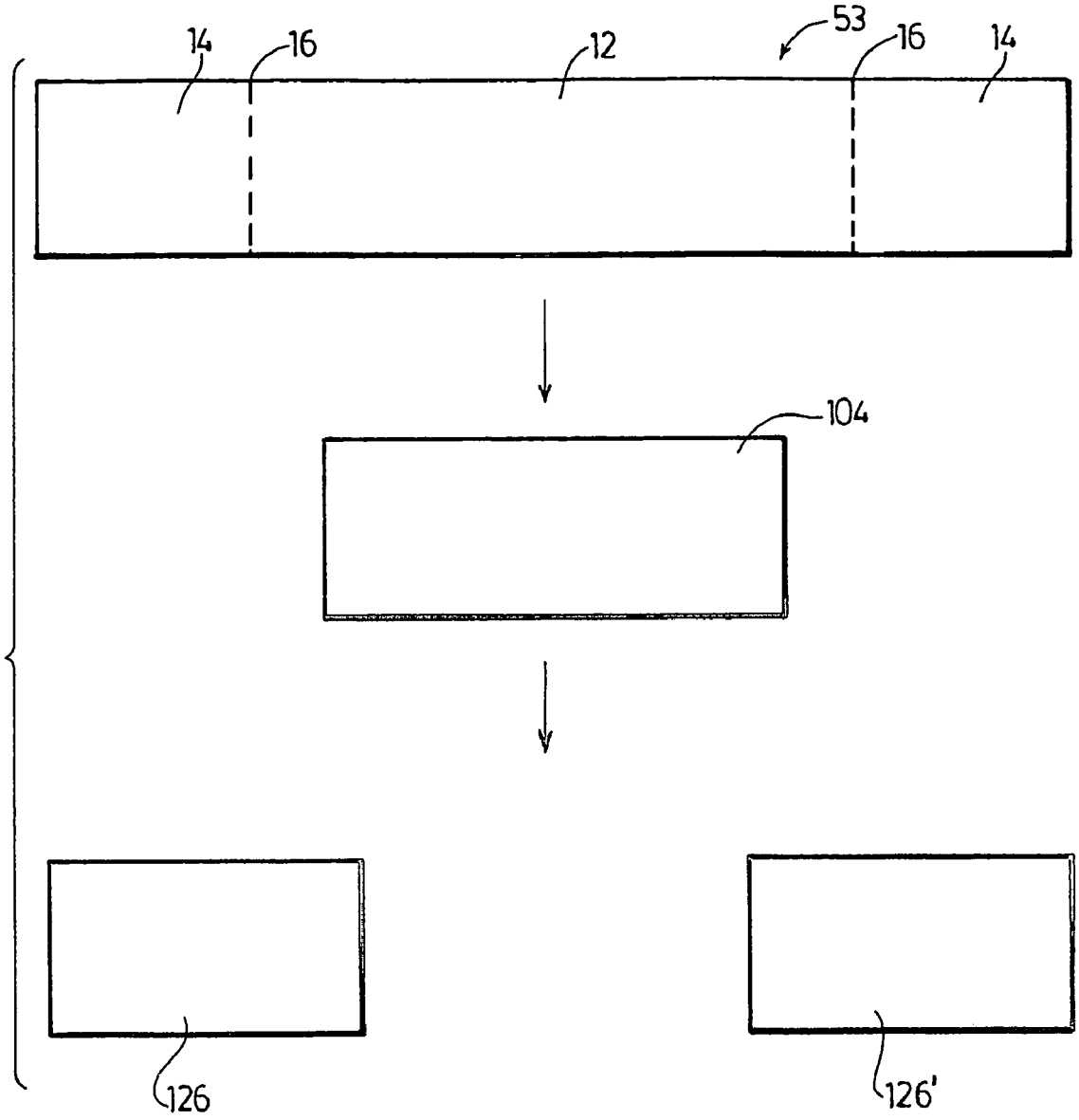
FIG. 32 schematically illustrates the steps in the method of FIGS. 23 to 31.

FIG. 32 illustrates the sequence of steps which may be followed in the method described above with reference to FIGS. 23 to 31. In the embodiment illustrated in FIG. 32, the blank 53 is fed transversely to a channel-forming die 104 and then to axially-aligned combined dies 126 and 126'. It will, however, be appreciated that the boss-forming dies are not necessarily axially aligned with one another.

Although the invention has been described in relation to certain preferred embodiments, it is not limited thereto. Rather, the invention includes all embodiments which may fall within the scope of the following claims.

What is claimed is:

1. A method for forming a plate for a heat exchanger, comprising:

(a) providing a flat sheet metal blank having a pair of elongate, longitudinally extending side edges and having end edges extending between the side edges, the side edges being parallel to each other such that the blank is of constant width, the blank having a central portion located between a pair of longitudinally-spaced end portions, wherein the width and length of the blank are substantially the same as a width and length of the plate;

(b) forming pair of raised shoulders in the central portion of the blank, the shoulders being spaced from one another and spaced from the side edges, wherein a raised fluid flow channel is defined between the shoulders, wherein a width of the central portion after formation of the shoulders defines a maximum width of the plate, and wherein the step of forming the fluid flow channel comprises:

(i) stamping a first channel portion having a proximal end portion and a distal end portion; and (ii) stamping a second channel portion having a proximal end portion and a distal end portion; wherein the proximal end portions overlap one another by a predetermined amount and the distal end portions are spaced from one another along the longitudinal axis; and (c) forming a pair of raised bosses in the blank, each of the bosses being formed in one of the end portions of the blank, each of the bosses having a pair of longitudinally-extending sides, having a longitudinal dimension which is greater than its transverse dimension, and being raised relative to the side edges and the fluid flow channel;

wherein, during formation of the bosses, material from the end portions of the blank is drawn inwardly toward the bosses, thereby causing the side edges to converge inwardly toward one another along the sides of the bosses, such that a transverse distance between the side edges reaches a minimum along the sides of the bosses;

wherein said minimum transverse distance between the side edges defines a minimum width of the plate; and wherein the shoulders and the bosses are sufficiently spaced from the side edges of the plate such that a continuous flange is formed along an entire periphery of the plate.

2. The method of claim 1 wherein the first channel portion is formed by a first channel-forming die and the second channel portion is formed by a second channel-forming die, wherein at least one of the first and second channel-forming dies is movable along the longitudinal axis.

3. The method of claim 2 wherein both the first and second channel-forming dies are movable along the longitudinal axis.

4. The method of claim 2 further comprising the step of moving one or both of the channel-forming dies along the longitudinal axis to increase or decrease an amount of overlap between the distal end portions of the first and second channel portions.

5. The method of claim 1 wherein the predetermined amount of overlap is sufficient to blend the proximal end portions of the first and second channel portions together, such that the fluid flow channel has a substantially uniform cross section between the distal end portions.

6. The method of claim 1 wherein the predetermined amount of overlap is at least about 1 inch measured along the longitudinal axis.

7. The method of claim 1 wherein the first channel portion is formed by a channel-forming die;

wherein the second channel portion and one of the raised bosses are formed together by one or more stamping operations, and wherein at least one of the stamping operations comprises stamping the strip with a combined die having a boss-forming portion and a channel-forming portion.

8. The method of claim 7 wherein the channel-forming die for forming the first channel portion is fixed in position relative to the longitudinal axis.

9. The method of claim 7 wherein the combined die is movable along the longitudinal axis so as to vary the predetermined amount of overlap.

10. The method of claim 1 wherein the shoulders terminate so as not to substantially extend into the end portions.

11. The method of claim 1 further comprising the step of:

(d) forming an aperture in an upper surface of each of the bosses.

12. The method of claim 11 wherein each of the apertures is formed in a central portion of the upper surface of one of the bosses.

13. The method of claim 11 wherein both the apertures are elongated along the longitudinal dimensions of the bosses.

14. An apparatus for forming a heat exchanger plate from a flat, sheet metal blank, the heat exchanger plate having a central portion defining an elongate fluid flow channel extending along a longitudinal axis, a pair of end portions separated by the central portion, and raised bosses provided in each of the end portions, each of the raised bosses being provided with a fluid flow aperture and having an interior in communication with the fluid flow aperture and the fluid flow channel, the apparatus comprising a plurality of dies for forming the fluid flow channel and the raised bosses, the dies including:

(a) a first channel-forming die for forming a first portion of the fluid flow channel in said blank;

(b) a second channel-forming die for forming a second portion of the fluid flow channel in said blank, wherein the first and second channel-forming dies are axially overlapping such that an area of overlap is formed where the first portion of the fluid flow channel overlaps the second portion of the fluid flow channel; and (c) a plurality of dies for forming the raised bosses;

wherein at least one of the first and second channel-forming dies is movable along the longitudinal axis so as to vary the area of overlap.

15. The apparatus of claim 14 wherein the dies for forming the bosses are fixed in position relative to the longitudinal axis.

16. The apparatus of claim 14 wherein the second channel-forming die comprises a combined die having a boss-forming portion for forming one of the raised bosses and a channel-forming portion for forming the second channel portion, wherein the boss-forming portion comprises one of said dies for forming the raised bosses.

17. The apparatus of claim 16 wherein the first channel-forming die is fixed in position relative to the longitudinal axis and the second channel-forming die is movable along the longitudinal axis.

18. The apparatus of claim 16 wherein the combined die is movable along the longitudinal axis so as to vary the predetermined amount of overlap.

19. The apparatus of claim 16 further comprising:

a third channel-forming die for forming a third portion of the fluid flow channel which overlaps the first portion of the channel and is distal to the second portion of the channel, wherein the first and third channel-forming dies are axially positioned relative to one another such that an area bf overlap is formed where the first portion of the fluid flow channel overlaps the third portion of the fluid flow channel;

wherein the first channel-forming die is fixed in position relative to the longitudinal axis and both the second and third channel-forming dies are movable along the longitudinal axis so as to vary the areas of overlap; and wherein the third channel-forming die comprises a combined die having a boss-forming portion for forming one of the raised bosses and a channel-forming portion for forming the third channel portion.

20. The apparatus of claim 14 wherein the first and second channel-forming dies are located at different stamping stations which are transversely spaced from one another.

21. The method according to claim 1 wherein the first and second channel portions are stamped at different stamping stations which are transversely spaced from one another, and wherein blank is moved transversely between the stamping of the first channel portion and the stamping of the second channel portion.

* * * * *

UNITED STATES PATENT AND TRADEMARK OFFICE

CERTIFICATE OF CORRECTION

PATENT NO. : 7,681,313 B2
APPLICATION NO. : 10/547049
DATED : March 23, 2010
INVENTOR(S) : Peter Zurawel et al.

It is certified that error appears in the above-identified patent and that said Letters Patent is hereby corrected as shown below:

At claim 1, column 11, paragraph (b), line 31, --a-- should be inserted between "forming" and "pair"; and At claim 19, column 14, line 1, "bf" should be replaced by --of--.

Signed and Sealed this

Twenty-second Day of June, 2010

David J. Kappos

David J. Kappos
*Director of the United States Patent and Trademark Office*